United States Patent [19]

Chiarot

[11] Patent Number: 4,988,007

[45] Date of Patent: Jan. 29, 1991

[54] MODULAR SKI RACK AND MOUNTING KIT

[76] Inventor: John B. Chiarot, 32 Golf Valley Lane, Etobicoke, Ontario, Canada, M9C 2K3

[21] Appl. No.: 540,176

[22] Filed: Jun. 19, 1990

[51] Int. Cl.[5] ..... A47F 7/00

[52] U.S. Cl. ..... 211/70.5; 211/94; D6/552

[58] Field of Search ..... 211/70.5, 70.6, 94, 211/162; 248/225.1; D6/552

[56] References Cited

U.S. PATENT DOCUMENTS

| | | | |
|---|---|---|---|
| 2,956,813 | 10/1960 | Madden | 211/70.5 X |
| 3,515,284 | 6/1970 | Taylor | 211/94 X |
| 4,778,065 | 10/1988 | Chiarot | 211/70.5 |
| 4,793,496 | 12/1988 | Wait | 211/70.5 |

FOREIGN PATENT DOCUMENTS

| | | | |
|---|---|---|---|
| 602066 | 7/1978 | Switzerland | 211/70.5 |

*Primary Examiner*—Robert W. Gibson, Jr.
*Attorney, Agent, or Firm*—Ridout & Maybee

[57] ABSTRACT

A modular ski hanger system and kit for mounting the same, is provided with a bracket member which may be mounted on a vertical surface. Ski hanger modules, which may be slidably mounted on the bracket member, each have an upright thickened back portion and a pair of substantially parallel upright wall members forwardly projecting from the back portion. The wall members are spaced apart by enough distance to permit insertion of a pair of typical skis arranged base-to-base at a portion adjacent their curved front ends, and the wall members have a dimension parallel to the back portion which is great enough to ensure that the pair of typical skis received between them will be maintained together by the wall members without slipping down. This allows two ski hangers to be positioned with one inverted with respect to the other, allowing close spacing of the skis. A cylindrical plug member may be inserted through opposed apertures in the wall members of a module in order to provide abutment means to retain the pair skis in the module against forward lateral sliding. Apertures of adjacent inverted modules are substantially aligned so that locking means may be threaded along the length of a series of modules to lock all skis in place, or alternatively, a single locking means may be inserted through a lateral aperture in the plug member to prevent removal of the plug member from the module.

20 Claims, 2 Drawing Sheets

MODULAR SKI RACK AND MOUNTING KIT

BACKGROUND OF THE INVENTION

1. Field of the Invention

This invention relates generally to ski racks, and particularly to a modular ski rack system and mounting kit designed in such a way as to lock into place and store several pairs and types of skis vertically in the least possible volume.

2. Description of the Related Art

In my U.S. Pat. No. 4,778,085 dated Oct. 18, 1988, an integral, wall mountable ski rack for the vertical hanging of skis was described.

As is well known, skis differ widely in length, size and degree of curvature at the tip. Moreover, downhill skis differ markably in configuration and length from cross-country skis.

It is therefore an object of the present invention to provide a ski hanging rack capable of accommodating and retaining different types and sizes of skis, in which the horizontal positioning of the skis can be adjusted.

It is a further object of the present invention to provide a ski hanging apparatus in which adjacent pairs of skis are suspended such that one of the pairs is higher than the other, thus allowing the tips of the lower pair to occupy the crook formed by one of the skis of the higher pair.

SUMMARY OF THE INVENTION

According to the invention, there is provided a mounting kit for a modular ski rack system consisting of a bracket member having two oppositely projecting parallel marginal flanges. The bracket member is adapted to be mounted on a vertical surface with the marginal flanges horizontally disposed and spaced from the surface. Means for mounting the bracket member on the surface are provided, and at least one ski hanger module is provided. Each ski hanger module consists of an upright thickened back portion having a race defined therethrough for loosely engaging the marginal flanges for slidably mounting the ski hanger module on the bracket member, and a pair of substantially parallel upright wall members forwardly projecting from the back portion. The wall members are spaced apart by enough distance to permit insertion of a pair of typical skis arranged base-to-base at a portion adjacent their curved front ends. The wall members also have a dimension parallel to the back portion which is great enough to ensure that the pair of typical skis received therebetween will be maintained together by the wall members without slipping down through them. Disengagable abutment means for retaining the pair of typical skis in the module against forward lateral sliding are also provided.

Preferably, the wall members of each module have an aligned pair of apertures defined therethrough to receive, in sliding engagement, a plug bridging the wall members to act as the abutment means.

According to another aspect of the invention, a ski hanger module for use in combination with a bracket member of the type having two oppositely projecting parallel marginal flanges is provided. The module consists of an upright thickened back portion having a race defined therethrough for loosely engaging the marginal flanges of the bracket member for slidably mounting the ski hanger module on the bracket member. A pair of substantially parallel upright wall members forwarding project from the back portion and are spaced apart by enough distance to permit insertion of a pair typical skis arranged base-to-base, at a portion of the skis adjacent their curved front ends. The wall members have a dimension parallel to the back portion which is great enough to ensure that a pair of typical skis received therebetween will be maintained together by the wall members without slipping through them. Disengageable abutment means are also provided for retaining the pair of typical skis in the module against forward lateral sliding.

DETAILED DESCRIPTION OF THE PREFERRED EMBODIMENTS

Figure 1:
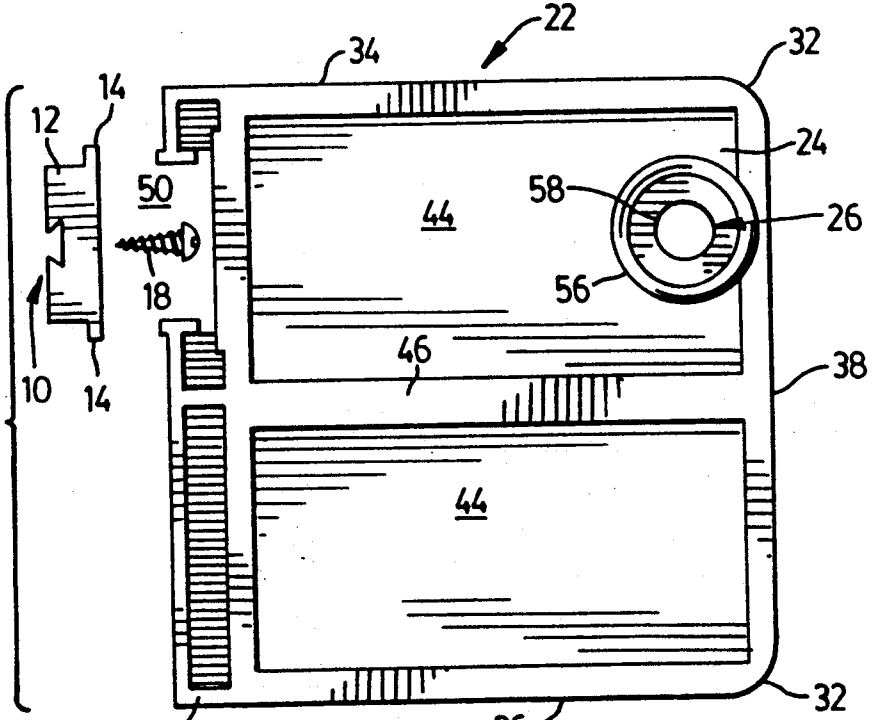
FIG. 1 is a side view of a ski hanger module, according to the invention, also showing a bracket member and attachment means in end view.

Referring first to FIG. 1, a bracket member 10 which is elongate and has a constant section comprising a flat central portion 12 two co-planer marginal flanges 14, is provided. The bracket member 10 has a plurality of evenly spaced tapered or inset openings 16 (visible in FIG. 3) adapted to receive fasteners 18 and 20 (shown in FIG. 1) for the purpose of securing the bracket member 10 to a vertical surface such as a wall or upright wall studs. Plastic caps or similar attachments may be placed over fasteners 18 and 20 and over unused openings 16 for aesthetic appearances.

Figure 2:
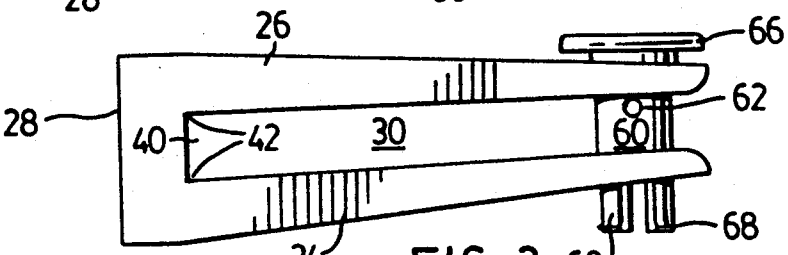
FIG. 2 is a plan view of the ski hanger module of FIG. 1 having inserted therethrough one embodiment of the abutment means.

A ski hanger module 22 is also shown in FIGS. 1 and 2. In the preferred embodiment, it is constructed as an integral unit and comprises two upright spaced apart wall members 24 and 26, joined by an upright thickened back portion 28.

The thickened back portion has a race 50 in the form of a T-shaped channel which is shaped to receive and grip the bracket 10 by providing a quasi dovetail fit over the bracket in close sliding relation with the marginal flanges 14. To permit sliding movement of the hanger module 22 along the bracket member 10, and this lateral adjustment of a number of modules on the bracket member 10, fasteners 20 are preferably flat-headed screws which are flush with the central portion 12 of the bracket member 10 when fully inserted. Fasteners 18 are preferably round headed screws and are mounted through the apertures at each end of the bracket of the modules 22 from the bracket 10.

Figure 4:
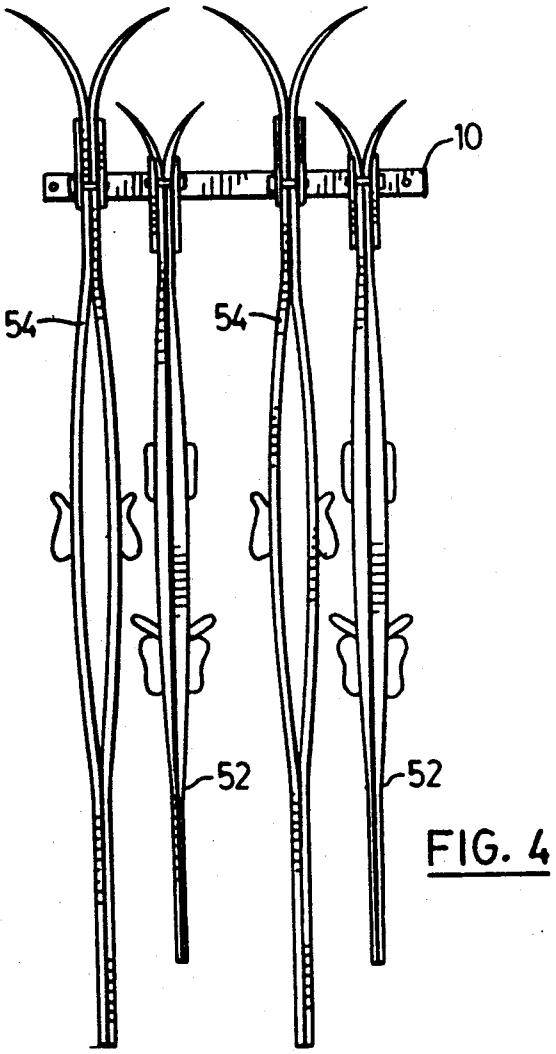
FIG. 4 is a front view, to a smaller scale, showing a bracket member on which four ski hanger modules are mounted, and four pairs of skis being supported.

As also shown in FIGS. 1 and 2, the two wall members 24 and 26 are substantially parallel and are spaced apart to provide an internal slot 30 which is great enough to permit insertion of a pair of typical skis at a portion adjacent the curved front ends of the skis arranged base-to-base, in the manner illustrated in FIG. 4.

The wall members 24 and 26 are substantially rectangular, being provided with top edges 34, bottom edges 36 and front edges 38, connected by rounded rightward corners 32, and rear edges 40. The upright back portion 28 integrally interconnects the wall portions 24 and 26 along the rear edges 40. It is preferable that these inner corners be radiused, as shown at filets 42, to prevent cracking of the ski hanger module diagonally from these internal corners.

Figure 3:
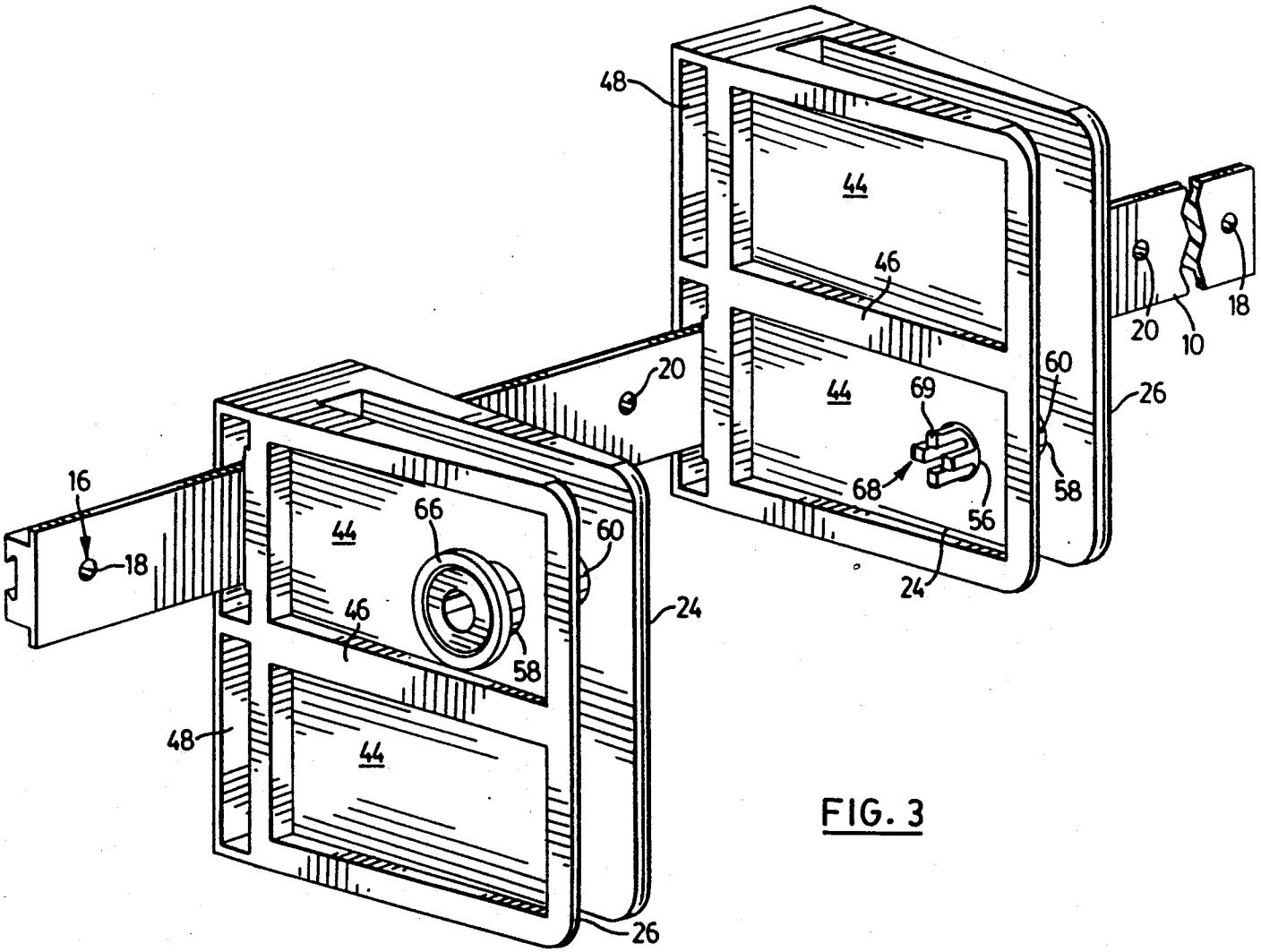
FIG. 3 is a perspective view showing two ski hanger modules mounted on a bracket member, the hanger modules being inverted with respect to each other and both incorporating the abutment means.

As best seen in FIG. 3, each of the wall members 24 and 26 have two rectangular recessed areas 44 in their outside surfaces, separated by median horizontal rib 46. The upright back portion 28 incorporates elongated recesses 48 at either side (only one visible for each ski hanger module in FIG. 3). The purpose of the recessed portions 44 and the elongated recesses 48 is to reduce the amount of material in the ski hanger module 22, while maintaining maximum strength thereof.

The wall members 24 and 26 have a dimension parallel to the upright back portion 28 (i.e. vertical in FIG. 1) which is great enough to ensure that a pair of typical skis received between the wall portions will be maintained together by the wall portions without slipping down through them. It will be appreciated that, in the absence of tying together the bottom ends of the pair of skis, if the vertical dimension of the wall portions were not great enough, the skis could slide down through the opening between the wall members by separating at the bottom, as described in my U.S. Pat. No. 4,778,065. As a practical matter, it has been found that the spacing between the wall members 24 and 26 should be at least about 17 mm in order to accommodate most typical skis, and the vertical dimension of the wall members, as seen in FIG. 1, should be at least about 5½inches. It will be appreciated by those skilled in the art, that the wall spacing can be greater than 17 mm, but it would then be necessary to correspondingly increase the vertical dimension of the wall member.

With the structure described above, two such ski hanger modules 22 can be positioned on a single bracket member 12 with one of them inverted with respect to the others, as pictured in FIG. 3. This results in one of the ski hanger modules being located higher than the other, and this in turn allows two pairs of skis to be hung therethrough in close spacing with the curve tips of one pair being disposed generally above the curved tips of the adjacent pair. This is well illustrated in FIG. 4, which shows a single bracket member 12 with four ski hanger modules 22 positioned thereon, two alternate ski hanger modules being in the lower orientation and the other two being in the upper orientation.

FIG. 4 shows two pairs of downhill skis 52 positioned in alternate ski hanger modules in the lower orientation, with two pairs of cross-country skis 54 positioned in the other two ski hanger modules in the upper orientation. As can be seen, the curved tips of the downhill skis 52 are positioned within the crook, on either side, of the curved tips of the cross-country skis 54, thus allowing for the closest possible spacing of the skis.

As also illustrated in FIGS. 1 and 3, the two wall members 24 and 26 of each ski hanger module 22 have apertures 56 and 58, the aperture 58 of one wall member being of smaller diameter then the aperture 56 of the wall member superimposed on it. Aperture 58 is substantially centrally aligned with aperture 56.

As illustrated in FIG. 2, a plug 60 may be inserted through the apertures to act as an abutment means for retaining the skis in the ski hanger module 22 against forward lateral slipping.

A lateral aperture 62 is formed through the plug for accommodating a projecting pin or the shackle of a padlock or similar locking means (not shown), to prevent removal of the plug from sliding engagement in the apertures 56 and 58.

As can be seen from FIG. 3, the apertures 56 and 58 of adjacent ski hanger modules mounted on a bracket member 12 will substantially align. The plug 60 is also shown as a cylindrical member to accommodate a single rod or chain to be threaded through a plurality of plugs of a series of ski hanger modules, to lock the skis in position in the ski rack.

As shown in FIG. 3, each cylindrical plug 60 is provided with circumferential end lips 66 and 68. Both circumferential end lips have a circumference greater than the allowance of aperture 58, and act as a stop means. The end of cylindrical plug 60 having circumferential lip 58 is formed as a circular array of fingers 69 permitting slight compression of the plug end for initial insertion through the smaller aperture 58 on assembling the module 22.

While one embodiment of this invention has been illustrated in the accompanying drawings and described above, it will be evident to those skilled in the art that changes and modifications may be made therein without departing from the essence of this invention, as set forth in the appended claims.

I claim:

1. A mounting kit for a modular ski rack system, comprising:

a bracket member having two oppositely projecting parallel marginal flanges, the bracket member adapted to be mounted on a vertical surface with said marginal flanges horizontally disposed and spaced from the surface;

means for mounting the bracket member on the surface;

at least one ski hanger module, each such module having:

an upright thickened back portion with a race defined therethrough for loosely engaging the marginal flanges for slidably mounting the ski hanger module on the bracket member; and a pair of substantially parallel upright wall members forwardly projecting from the back portion and spaced apart by enough distance to permit insertion of a pair of typical skis arranged base-to-base at a portion adjacent their curved front ends, the wall members having a dimension parallel to the back portion which is great enough to ensure that the pair of typical skis received therebetween will be maintained together by the wall members without slipping down through them; and disengageable abutment means for retaining the pair of typical skis in the module against forward lateral sliding.

2. A mounting kit for a modular ski rack system, according to claim 1, wherein two such ski hanger modules can be positioned on the same bracket member with one inverted with respect to the other so that one of them is located higher than the other, thus allowing two pairs of skis to be hung thereon at close proximity with the curved tips of one pair being disposed generally above the curved tips of the adjacent pair.

3. The mounting kit for a modular ski rack system, according to claim 2, wherein the wall members of each module have a pair of opposed apertures defined therethrough remote from the back portion, and wherein the abutment means for each module comprises a plug threadable through the two apertures for bridging the two wall members.

4. A mounting kit for a modular ski rack system, according claim 3, wherein the pair of apertures defined through the wall members of each module substantially align with the pair of apertures of an adjacent inverted module.

5. A mounting kit for a modular ski rack system, according to claim 3 or 4, wherein the plug is a rigid cylindrical body adapted to receive threaded therethrough a locking chain.

6. A mounting kit for a modular ski rack system, according to claim 1, wherein the wall members are generally rectangular, the ski hanger module is an integral unit, and the race is defined by a channel of T-shaped configuration.

7. A mounting kit for a modular ski rack system, according to claim 1 or 6, wherein the spacing between the wall members is at least about ¾ inch, and wherein the said dimension of the wall members parallel to the back portion is at least about 5½inches.

8. A mounting kit for a modular ski rack system, according to claim 1, wherein the bracket member has a constant section comprising a flat central portion, the marginal flanges being substantially co-planer and extending in opposite directions from the said central portion, the bracket member having a plurality of spaced apart openings along the flat central portion for receiving fasteners whereby to mount the bracket member on the surface.

9. A mounting kit for a modular ski rack, according to claim 8, further comprising stop means for preventing removal of modules from the bracket member, said stop means adapted to be mounted through openings spaced at the extreme ends of the bracket member.

10. A ski hanger module for use in combination with a bracket member having two oppositely projecting parallel marginal flanges, the bracket member being adapted to be mounted on a vertical surface with said marginal flanges horizontally disposed and spaced from the surface, comprising:

an upright thickened back portion having a race defined therethrough for loosely engaging the marginal flanges for slidably mounting the ski hanger module on the bracket member; a pair of substantially parallel upright wall members forwardly projecting from the back portion and spaced apart by enough distance to permit insertion of a pair of typical skis arranged base-to-base at a portion of the skis adjacent their curved front ends, the wall members having a dimension parallel to the back portion which is great enough to ensure that the pair of typical skis received therebetween will be maintained together by the wall members without slipping down through them; and disengageable abutment means for retaining the pair of typical skis in the module against forward lateral sliding.

11. A ski hanger module, according to claim 10, wherein each wall member has an aperture defined therethrough remote from the back portion, and wherein the abutment means comprise a plug threadable through the two apertures for bridging the two wall members.

12. A ski hanger module, according to claim 11, wherein the two apertures through the wall members are at least partially aligned, and wherein the plug is a rigid body.

13. A ski hanger module, according to claim 11 or 12, wherein the plug is a cylindrical body adapted to receive threaded therethrough a locking chain.

14. A ski hanger module, according to claim 12, wherein the plug has defined therein a lateral aperture adapted to receive a projecting pin for preventing removal of the plug through either of the two apertures in the wall member.

15. A ski hanger module, according to claim 14, wherein the lateral aperture defined in the plug is a through aperture adapted to receive the shackle of a locking means.

16. A ski hanger module, according to claim 12, wherein the aperture through one of the wall members is of smaller diameter and is substantially centrally aligned with the aperture through the opposed wall member, and wherein the plug has abutment means at both ends to prevent removal of the plug from the module through the smaller aperture.

17. A ski hanger module, according to claim 16, wherein the plug has a circular array of fingers defined at one end thereof, said circular array of fingers being compressible for inserting the plug through the smaller aperture.

18. A ski hanger module, according to claim 10, wherein the wall members are generally rectangular, the ski hanger module is an integral unit, and the race is defined by a channel of T-shaped configuration.

19. A ski hanger module, according to claim 10 or 18, wherein the wall members have opposed filets connecting to the back portion.

20. A ski hanger module, according to claim 10 or 18, in which the spacing between the wall members is at least about 17 mm, and in which the said dimension of the wall members parallel to the back portion is at least about 5½inches.

* * * * *